US008783238B2

(12) United States Patent
Julian

(10) Patent No.: US 8,783,238 B2
(45) Date of Patent: Jul. 22, 2014

(54) COMBINATION ARCHER BOW FIELD CARRY DEVICE/STABILIZER/COUNTERBALANCE

(76) Inventor: Anythony A. Julian, Scottsdale, AZ (US)

( * ) Notice: Subject to any disclaimer, the term of this patent is extended or adjusted under 35 U.S.C. 154(b) by 346 days.

(21) Appl. No.: 13/094,914

(22) Filed: Apr. 27, 2011

(65) Prior Publication Data

US 2011/0259314 A1 Oct. 27, 2011

Related U.S. Application Data

(60) Provisional application No. 61/328,241, filed on Apr. 27, 2010.

(51) Int. Cl.
*F41B 5/14* (2006.01)
*F41B 5/20* (2006.01)

(52) U.S. Cl.
USPC ..... 124/86; 124/89

(58) Field of Classification Search
USPC ..... 124/89, 86, 88; 411/400
See application file for complete search history.

(56) References Cited

U.S. PATENT DOCUMENTS

| | | | | |
|---|---|---|---|---|
| 131,100 | A * | 9/1872 | Hubbard | 411/400 |
| 3,524,441 | A * | 8/1970 | Jeffery | 124/89 |
| 3,589,350 | A * | 6/1971 | Hoyt et al. | 124/89 |
| 5,520,164 | A * | 5/1996 | Huddleston | 124/86 |
| 5,735,257 | A * | 4/1998 | Walk | 124/89 |
| 6,076,514 | A * | 6/2000 | Adams, Jr. | 124/89 |
| 6,997,174 | B2 * | 2/2006 | Sandberg | 124/89 |
| 7,213,590 | B2 * | 5/2007 | Pellerite | 124/89 |
| 2010/0031946 | A1 * | 2/2010 | LoRocco | 124/89 |

* cited by examiner

*Primary Examiner* — John Ricci
(74) *Attorney, Agent, or Firm* — Gianna Julian-Arnold; Saul Ewing LLP

(57) ABSTRACT

A carrying device for an archery bow that attaches to the threaded port on an archery bow that is typically intended for attachment to a "stabilizer" or "counterbalance". The carrying device can be provided as a kit customizable by the user, which deploys common materials utilized for the purpose of counterbalancing and stabilizing an archery bow, and, dampening vibration or noise. The user is able to manipulate components of the device to provide customized ballast and vibration dampening effect. The carrying component is an eyelet, hoop, ring, or hook, formed or machined, onto or into which the ballast/vibration dampening components are assemble. The carrying component is readily clipped to a users sling, back pack, belt, etc., for the purpose of hands free carrying of the bow.

19 Claims, 4 Drawing Sheets

COMBINATION ARCHER BOW FIELD CARRY DEVICE/STABILIZER/COUNTERBALANCE

CROSS-REFERENCE TO RELATED APPLICATIONS

This application claims priority to the U.S. provisional application 61/328,241 filed on Apr. 27, 2010, the contents of which are incorporated in its entirety.

FIELD OF THE INVENTION

The present invention relates to archery. Specifically, the present invention relates to a field carry device having further utility to stabilize and provide counterbalance.

BACKGROUND OF THE INVENTION

In the field of archery, both target shooting and hunting, there are specific needs for counterbalancing the bow, dampening vibrations induced by shooting the bow, and hands free carrying of the bow, which are typically unique to the specific archer's preference and type of bow being utilized.

Counterbalance devices are generally available. The counterbalance attaches to a common threaded insert, standard in the body of the bow. Similarly vibration dampening devices are available on the market. These attach to the same threaded insert as the counterbalance described above. Hands free carrying of the bow has been addressed by various sling devices that attach to various components of the bow. However, existing field carrying devices tend to be too complicated to attach to the bow, and typically are a nuisance to shoot the bow while still attached, or cannot be attached to the bow at all when being fired. This makes the archer's ability to switch from carrying to shooting very slow.

There is therefore a need for a device that supplies the archer with a secure, rapid access and switch to shooting means of carrying the bow, which incorporates the utilities of vibration dampening and counterbalancing, all in one component resulting in less equipment needed in the field.

SUMMARY OF THE INVENTION

The present invention provides a means for counterbalancing the bow, dampening vibrations induced by shooting the bow, and hands free carrying of the bow, in a modular or customizable fashion, which the archer can fine tune the device to his/her specific needs.

It is an object of the invention to provide secure, hands free, rapid access means for the archer to carry the bow in the field.

It is further an object to assure the device while incorporated on the bow is transparent to the shooting process.

It is further an object to incorporate field carrying, vibration dampening, and counterbalancing into one, adjustable device.

It is further an object to integrate vibration dampening components which can be manipulated for tuning purposes It is further an object to integrate counterbalancing components, which can be manipulated for balancing purposes.

These and other objects are achieved in the present invention.

There has thus been outlined, rather broadly, the more important features of the invention in order that the detailed description thereof that follows may be better understood, and in order that the present contribution to the art may be better appreciated. There are, of course, additional features of the invention that will be described further hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that equivalent constructions insofar as they do not depart from the spirit and scope of the present invention, are included in the present invention.

For a better understanding of the invention, its operating advantages and the specific objects attained by its uses, reference should be had to the accompanying drawings and descriptive matter which illustrate preferred embodiments of the invention.

BRIEF DESCRIPTION OF THE DRAWINGS AND THE FIGURES

DETAILED DESCRIPTION OF THE INVENTION

The body of the invention is the host for the vibration dampening, and counter balancing components. In one embodiment this body of the carrying device is an elongated cylinder.

On one end of the body, a "first end", is a threaded feature or component for attaching to the threaded port on the body of the bow. This threaded feature can be attached to the body of the device or can be attachable to the body of the device.

On the other end, a "second end", is a feature which is used to carry the bow. Many aspects of this carrying means are contemplated, including but not limited to an j-bolt, eye-bolt, shouldered eye-bolt, welded eye-bolt, eyelet, hoop, ring or hook. The carrying means can be formed or machined, from a multitude of materials, including but not limited to metal, plastic, rubber and combinations thereof. In use the carrying means can be attached to a user's backpack, belt, sling, fanny pack, shoulder strap, or belt loop or similar as would be known by one of ordinary skill in the art.

The vibration dampening components are formed from suitable materials, including but not limited to rubber, neoprene, filled capsules, combinations thereof, and the like.

Filled capsules can by filled by many materials known by one of ordinary skill in the art, including but not limited to sand, gel, shot, particulates, and combinations thereof. These components are inserted and/or positioned onto the body of the invention to suit the archers specific needs.

Counterbalances are formed from suitable materials such as ballast materials including but not limited to steel, lead, brass, and combinations thereof. The counterbalance(s) are inserted and/or positioned onto the body of the invention to suite the archers specific needs. The counterbalance(s) can be cylindrical or tapered.

Through the insertion and/or positioning of the counterbalances and the vibration dampening components a user can obtain a preferred weighting and weight orientation of the device.

An advantage of the invention is the improved field carrying capability, it is safe and secure, the archer is in command of the bow while carrying, avoiding possible damage to the bow. The transition from carrying to shooting is seamless and fast, the invention remains in place while shooting, it does not need to be removed or adjusted. Another advantage of the invention is that it provides the needed vibration dampening and counter balance utility all in one device.

In one embodiment, the present invention includes a threaded feature on one end, and a field carrying feature on the other end. The appropriate amount of, and positioning of, vibration dampening and counterbalancing components are placed on the shank, the assembly is then screwed into the standard threaded port on the body of the bow.

Figure 1:
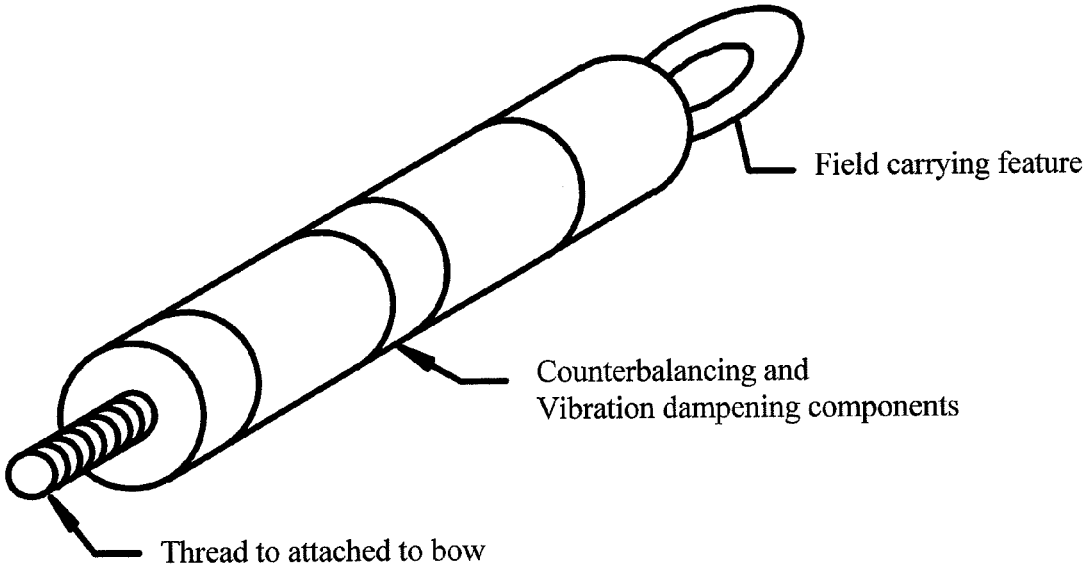
FIG. 1 is an isometric view of a generic assembly of the invention.

FIG. 1 illustrates an isometric view of a generic assembly, depicting the (3) major components referred to as: Field carrying feature, which is a rod of varying length comprised of metallic, fiber or plastic, which on one end has a formed or attached hoop or ring, and on the other end a thread compatible with the threaded insert typically housed in the archery bow. Vibration dampening components made from various suitable materials in a variety of cylindrical or tapered shapes. Counterbalancing components made from various suitable materials in a variety of cylindrical or tapered shapes. The vibration dampening and counterbalancing components are slide onto the rod of the field carrying feature in the order desired by the user. The assembly is then screwed into the corresponding threaded insert on the archer bow, the components are thus contained by the resulting pressure between the hoop and the bow itself.

Figure 2:
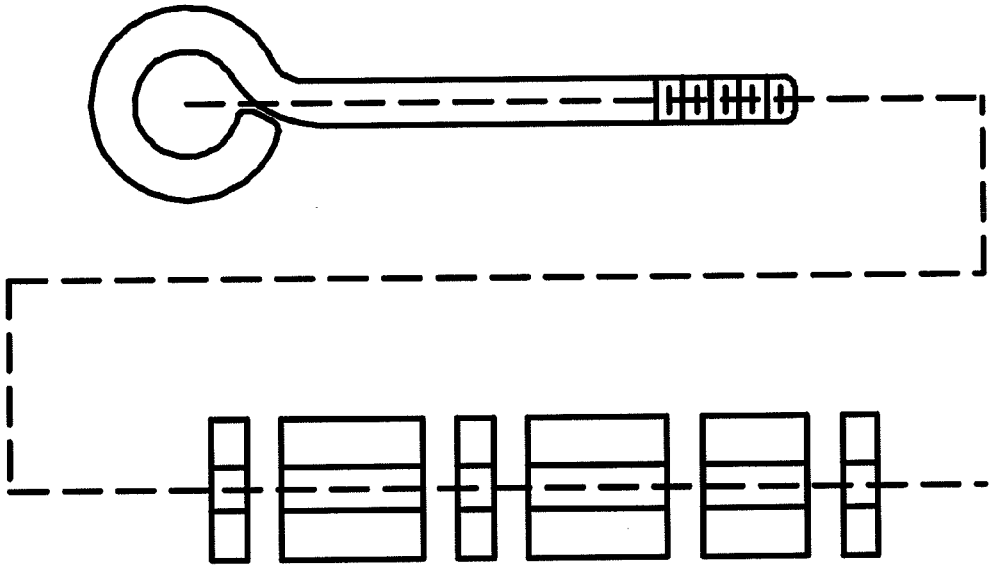
FIG. 2 is an assembly drawing, depicting an eyebolt style field carrying feature.

FIG. 2 illustrates an assembly drawing, depicting an eyebolt style field carrying feature, fabricated by typical means of producing a standard eyebolt. These vibration dampening and counterbalancing components are cylindrical in shape of various lengths, customizable to the archers need. These components are assembled similar to that described in FIG. 1.

Figure 3:
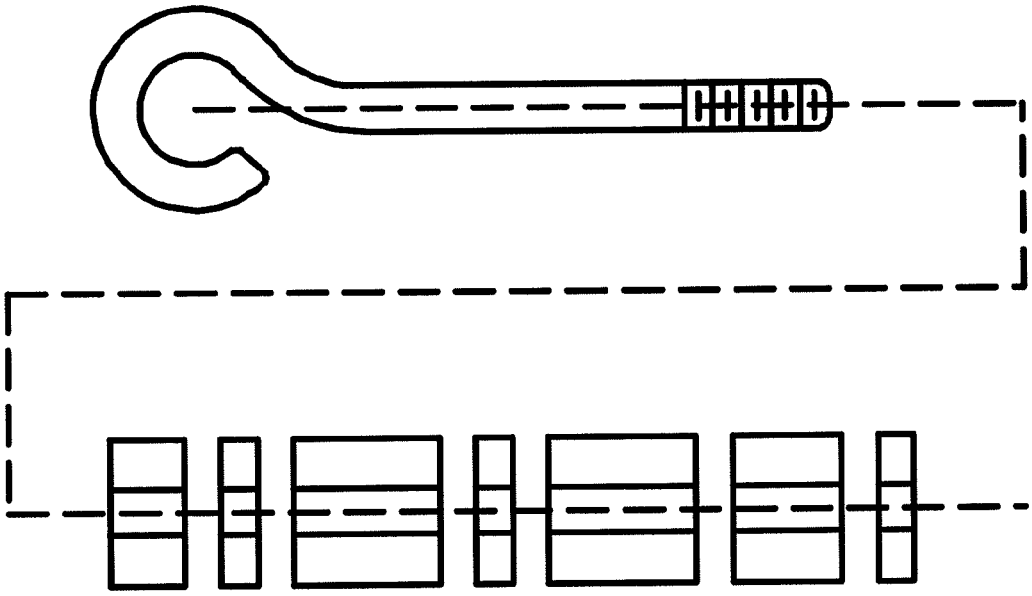
FIG. 3 is an assembly drawing depicting a J-bolt style field carrying feature.

FIG. 3 illustrates an assembly drawing depicting a J-bolt style field carrying feature, fabricated by typical means of producing a standard J-bolt. These vibration dampening and counterbalancing components are cylindrical in shape of various lengths, customizable to the archers need. These components are assembled similar to that described in FIG. 1.

Figure 4:
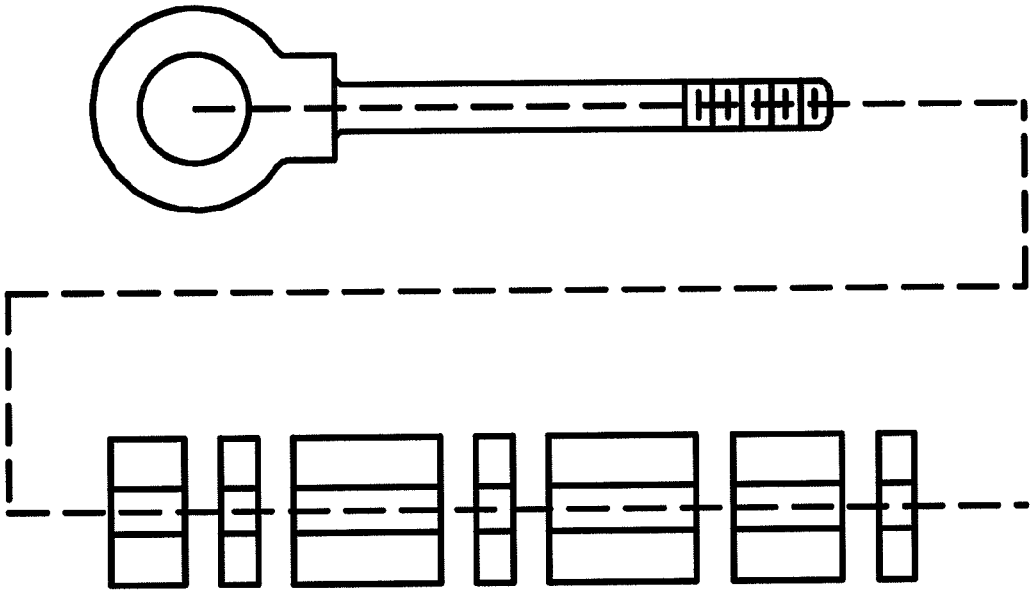
FIG. 4 is an assembly drawing depicting a shoulder bolt style field carrying feature.

FIG. 4 illustrates an assembly drawing depicting a shoulder bolt style field carrying feature, fabricated by typical means of producing a standard shoulder bolt. These vibration dampening and counterbalancing components are cylindrical in shape of various lengths, customizable to the archers need. These components are assembled similar to that described in FIG. 1.

Figure 5:
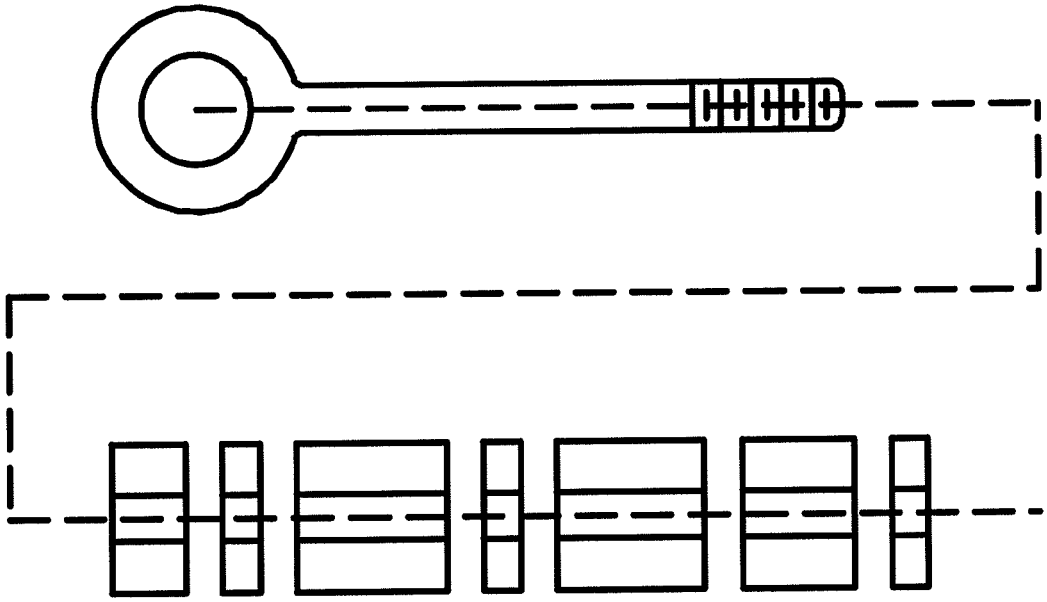
FIG. 5 is an assembly drawing depicting a welded eye bolt style field carrying feature.

FIG. 5 illustrates an assembly drawing depicting a welded eye bolt style field carrying feature, fabricated by typical means of producing a standard welded eye bolt. These vibration dampening and counterbalancing components are cylindrical in shape of various lengths, customizable to the archers need. These components are assembled similar to that described in FIG. 1.

Figure 6:
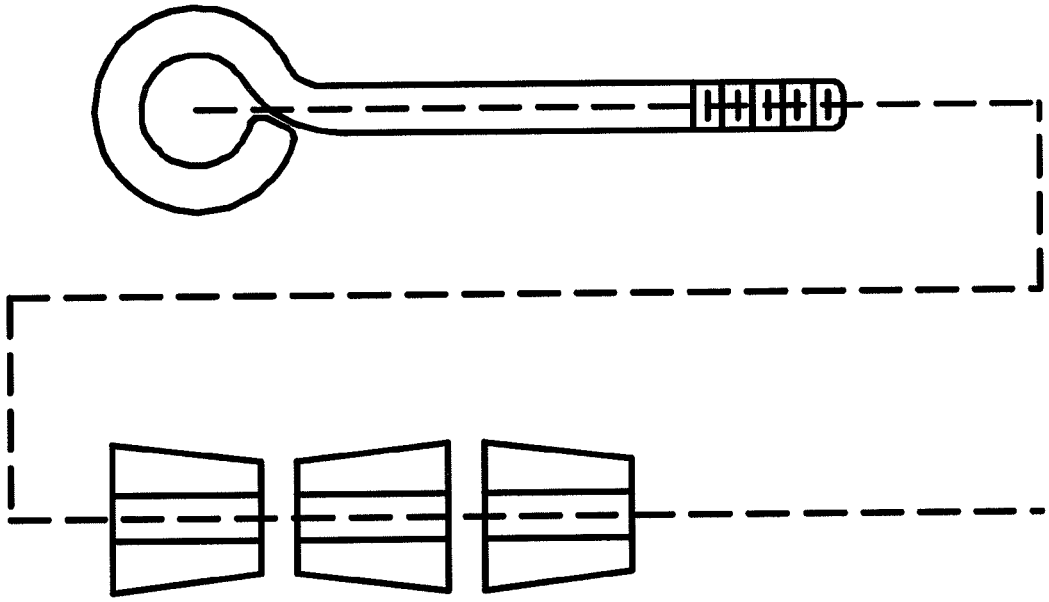
FIG. 6 is an assembly drawing depicting eyebolt style field carrying feature.

FIG. 6 illustrates an assembly drawing depicting an eyebolt style field carrying feature, utilizing tapered style vibration dampening and counter balancing components. These components are assembled similar to that described in FIG. 1.

Figure 7:
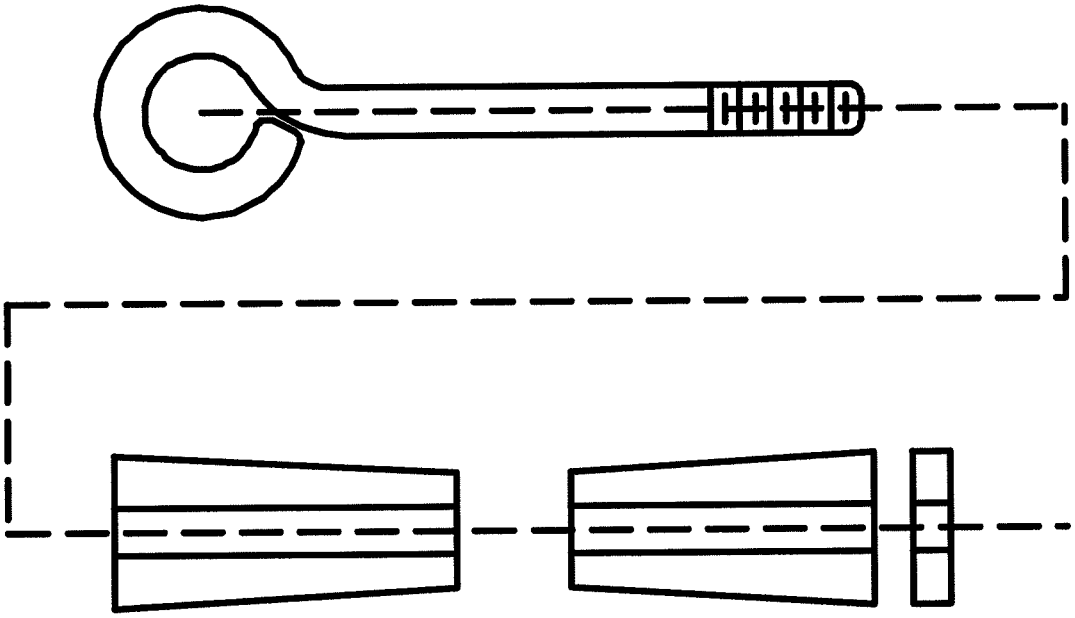
FIG. 7 is an assembly drawing depicting eyebolt style field carrying features.

FIG. 7 illustrates an assembly drawing depicting an eyebolt style field carrying features, utilizing tapered style vibration dampening and counter balancing components of different length. These components are assembled similar to that described in FIG. 1.

A contemplated use of the device disclosed herein is a method of carrying and stabilizing a bow. The user would position at least one counter balance and at least one vibration dampening material on a body of the device, to obtain a desired combination of vibration dampening and counterbalance. The user would attach the threaded component to a threaded port on the users bow. In varying embodiments this threaded component is attachable or attached to the device. The user would attach the carrying means to the user's backpack, belt, sling, fanny pack, shoulder strap, or belt loop.

Having now described a few embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention and any equivalent thereto. It can be appreciated that variations to the present invention would be readily apparent to those skilled in the art, and the present invention is intended to include those alternatives. Further, since numerous modifications will readily occur to those skilled in the art, it is not desired to limit the invention to the exact construction and operation illustrated and described, and accordingly, all suitable modifications and equivalents may be resorted to, falling within the scope of the invention.

What is claimed is:

1. A carrying device comprising:

a body, said body having a first end and a second end;

said first end further comprising a threaded component, wherein said threaded component is attachable or attached to said body, and wherein said threaded component is attachable to a threaded port on a bow;

said second end further comprising a carrying means, wherein said carrying means is either:

selected from the group of carrying means consisting of j-bolt, eye-bolt, shouldered eye-bolt, welded eye-bolt, eyelet, hoop, ring and hook; or attached to a user's backpack, belt, sling, fanny pack, shoulder strap, or belt loop: said body further comprising at least one of:

a vibration dampening material selected from the group of materials consisting of rubber, neoprene, filled capsules, and combinations thereof, or a ballast material selected from the group of ballast materials consisting of steel, lead, brass and combinations thereof.

2. The carrying device of claim 1, wherein said body is an elongated cylinder.

3. The carrying device of claim 1, wherein said threaded component is attached to said body.

4. The carrying device of claim 1, wherein said threaded component is attachable to said body.

5. The carrying device of claim 1, wherein said carrying means is selected from the group of carrying means consisting of j-bolt, eye-bolt, shouldered eye-bolt, welded eye-bolt, eyelet, hoop, ring and hook.

6. The carrying device of claim 1, said carrying means further comprising a material selected from the group of materials consisting of metal, plastic, rubber and combinations thereof.

7. The carrying device of claim 1, said body further comprising a vibration dampening material selected from the group of materials consisting of rubber, neoprene, filled capsules, and combinations thereof.

8. The carrying device of claim 7, wherein said filled capsules comprise sand, gel, shot, particulates, or combinations thereof.

9. The carrying device of claim 1, said body further comprising a ballast material selected from the group of ballast materials consisting of steel, lead, brass and combinations thereof.

10. The carrying device of claim 9, wherein said ballast material forms a counterbalance.

11. The carrying device of claim 10, wherein said counterbalance is cylindrical or tapered.

12. The carrying device of claim 10, wherein said counterbalance and/or said vibration dampening material are positioned on said body.

13. The carrying device of claim 10, wherein said counterbalance and said vibration dampening material are positioned by a user on said body to obtain a desired combination of vibration dampening and counterbalance.

14. The carrying device of claim 1, wherein said device is attached to said bow.

15. The carrying device of claim 1, wherein said threaded component is attached to a threaded port on a bow.

16. The carrying device of claim 1, wherein said carrying means is attached to a user's backpack, belt, sling, fanny pack, shoulder strap, or belt loop.

17. The carrying device of claim 1, wherein said device stabilizes a bow.

18. A carrying device comprising:

a body, wherein said body is an elongated cylinder and has a first end and a second end; said body further comprising a vibration dampening material selected from the group of materials consisting of rubber, neoprene, filled capsules, and combinations thereof; said body further comprising a ballast material selected from the group of ballast materials consisting of steel, lead, brass and combinations thereof, wherein said ballast material forms a counterbalance;

said first end further comprising a threaded component, wherein said threaded component is attachable or attached to said body, and wherein said threaded component is attachable to a threaded port on a bow;

said second end further comprising a carrying means, wherein said carrying means is selected from the group of carrying means consisting of j-bolt, eye-bolt, shouldered eye-bolt, welded eye-bolt, eyelet, hoop, ring and hook, said carrying means further comprising a material selected from the group of materials consisting of metal, plastic, rubber and combinations thereof;

wherein said counterbalance and said vibration dampening material are positioned by a user on said body to obtain a desired combination of vibration dampening and counterbalance.

19. A method of carrying and stabilizing a bow comprising:

positioning at least one counter balance and at least one vibration dampening material on a body, to obtain a desired combination of vibration dampening and counterbalance, said counter balance comprising a ballast material selected from the group of ballast materials consisting of steel, lead, brass and combinations thereof, said vibration dampening material selected from the group of dampening materials consisting of rubber, neoprene, filled capsules, and combinations thereof said body having a first end and a second end;

attaching a threaded component to a threaded port on said bow, wherein said threaded component is attachable or attached to said first end of said body; said second end of said body further comprising a carrying means, wherein said carrying means is selected from the group of carrying means consisting of j-bolt, eye-bolt, shouldered eye-bolt, welded eye-bolt, eyelet, hoop, ring and hook, said carrying means further comprising a material selected from the group of materials consisting of metal, plastic, rubber and combinations thereof; wherein said carrying means is attachable to a user's backpack, belt, sling, fanny pack, shoulder strap, or belt loop.

* * * * *